US005800267A

United States Patent [19]

Carlson et al.

[11] Patent Number: 5,800,267

[45] Date of Patent: Sep. 1, 1998

[54] PROGRESSIVE RESISTANCE DEVICE WITH SELF CENTERING FOR MULTI AXIAL MOTION INPUT

[76] Inventors: Douglas B. Carlson, 21235 W. Elliot Rd., Buckeye, Ariz. 85326; Donald Carlson, 1423 E. Pepper, Mesa, Ariz. 85203

[21] Appl. No.: 557,918

[22] Filed: Nov. 14, 1995

[51] Int. Cl.[6] ..... G05G 9/00

[52] U.S. Cl. ..... 463/38; 345/161; 74/481

[58] Field of Search ..... 463/37, 36, 38; 345/157, 161; 338/68; 74/68, 469, 479.01, 480 R, 481, 491

[56] References Cited

U.S. PATENT DOCUMENTS

| | | | |
|---|---|---|---|
| 2,295,836 | 9/1942 | Fernald | 35/12 |
| 3,170,332 | 2/1965 | Peters | 74/54 |
| 4,461,470 | 7/1984 | Astroth et al | 272/17 |
| 4,751,662 | 6/1988 | Crosbie | 364/578 |
| 4,856,771 | 8/1989 | Nelson et al. | 272/18 |
| 5,195,746 | 3/1993 | Boyd et al. | 273/148 |
| 5,436,640 | 7/1995 | Reeves | 463/38 |

*Primary Examiner*—George Manuel
*Attorney, Agent, or Firm*—Patrick M. Dwyer

[57] ABSTRACT

An apparatus for providing progressively increasing resistance to, and automatic self centering with respect to, an operator motion input to the apparatus. The apparatus has a crossbar with a longitudinal axis and is connected to a beam with a coupling. The beam has a longitudinal axis and is cantilever mounted on a base, with the crossbar mounted in a bearing for rotation about the crossbar's longitudinal axis. The respective longitudinal axes of the crossbar and the beam are parallel to each other. The bearing is rotatably mounted in another bearing, and the first and second bearings have axes of rotation mutually perpendicular to each other. The second bearing is mounted on the base, so that the crossbar is movable about the axis of rotation of the second bearing in response to input transverse forces acting on the crossbar, and the transverse input forces thereby produce a bending moment in the first beam through the coupling. A second beam has a longitudinal axis and is mounted its proximal end in a bracket that is attached to the crossbar, and it is engaged at its distal end in a support that is mounted on the base.

6 Claims, 4 Drawing Sheets

PROGRESSIVE RESISTANCE DEVICE WITH SELF CENTERING FOR MULTI AXIAL MOTION INPUT

TECHNICAL FIELD

The invention relates to the field of spring resistance devices in general; more particularly, it relates to multi axial motion input devices and to controllers for computer and video arcade games; and especially to an apparatus for progressive resistance to multi axial motion input (with self centering), and conversion of such motion into controller input for video arcade and computer games.

BACKGROUND OF THE INVENTION

Various devices and mechanisms exist to allow a game player or operator to control the images on a screen in a computer or video arcade game. As noted in U.S. Pat. No. 5,195,746 to Boyd issued Mar. 23, 1995, the disclosure of which is incorporated herein by reference as background as if fully set forth herein, such images and screen displays are typically controlled by user operated switches that are located on a separate "joy stick" or "game controller" module that interfaces with the circuitry of the game or computer. Such controllers are typically hand-sized and spring loaded. This leads to two difficulties.

Because the controllers are small, and because they are typically stabilized, if at all, by a suction cup type attachment to a table-like surface, the entire controller module is easily displaced during excited play, even by children. This module displacement is either read by the game as controller movement information, or is physically subtracted from intended controller movement information, in either case producing unlooked for results in the game, or is simply an annoyance and physical strain to the player. The larger the user, the greater the problem. Some especially large handed men find it difficult even to hold the joy stick in their hand. In video arcades, where the above problem is ameliorated by having the controller fastened to or integral to the game console, it is nonetheless reported that controller stick breakage from rough handling is a major concern in design of the user interface for such games. Finally, large adults simply cannot comfortably play with such controllers.

Another difficulty is with the spring mechanisms used to return the stick of the controller to some kind of "zero" or "center" position when hand force is relaxed or removed. On the one hand, such springs (especially in small hand sized devices) are small and weak, and relatively ineffective at anything but tactilely hinting at where the "center" should be. Larger springs, space permitting, are also contraindicated, since one of their effects would be to increase the tendency of the controller to come "unstuck" from the suction cup mountings. In addition, coil springs typically employed, in the way that they are employed, do not facilitate a progressively increasing resistance to the hand motions, such as there realistically might be if the joystick were really controlling a flying aircraft.

Finally, with conventional spring loading and pivoting of the joystick handle, the incremental lateral motions of the user's arm and hand (i.e., forward/back or "y" motions, and side to side or "x" motion) are not perfectly translated into spherical motion increments, but tend instead toward generation of delta points within a relatively planar circle. Thus repeated movement of the controller stick to the exact same "x-y" position simply fails to produce the precise same screen image movement or positioning each time as it should.

DISCLOSURE OF THE INVENTION

Accordingly, it is an object of the invention to provide an apparatus for progressive resistance to multi axial motion input (with self centering), and conversion of such motion into controller input for video arcade and computer games.

It is a further object of the invention to provide a game control mechanism with which large adults can comfortably play.

It is another object of the invention to provide a mechanism in a controller module that is not easily displaced during excited play.

It is another object of the invention to provide such a mechanism that is strong and durable and not readily subject to breakage during vigorous use.

It is a further object of the invention to provide a game control mechanism that provides realistic progressively increasing resistance to the motion of the user's hand or arm, and which provides for positive and precise automatic self centering, without aiding in the unwanted displacement of the controller module.

It is another object of the invention to provide such a mechanism that translates the lateral motions of the user's arm and hand, or preferably constrains the arm and hand motions, into genuine arcuate motions, which are then perfectly translated into spherical incremental motion to generate data points on the surface of a sphere, rather than within a circle in a plane, to more readily produce the precise same screen image movement or positioning each time the same "x-y" position motion is repeated.

It is yet another object of the invention to meet any or all of the needs summarized above.

These and such other objects of the invention as will become evident from the disclosure below are met by the invention disclosed herein.

The invention addresses and provides such a system. The invention represents an advance in game control mechanisms and other mechanisms where increased ruggedness, durability, and ability to accommodate large as well as small persons, is desirably combined with increased precision, sensitivity and realism of response and motion input.

The invention comprises an apparatus for providing progressively increasing resistance to, and preferably automatic self centering with respect to, an operator motion input to the apparatus. It has a preferably hollow and tubular crossbar with its own a longitudinal axis, and the crossbar is connected to a first beam by a coupling. The first beam has its own longitudinal axis and is cantilever mounted on a base. The crossbar is slidably engaged in a first bearing for rotation in the bearing about the crossbar's longitudinal axis. The respective longitudinal axes of the crossbar and the first beam are preferably generally parallel to each other, but do not have to be. The first bearing itself is rotatably mounted on a second bearing, so that the first and second bearings have axes of rotation mutually perpendicular. The second bearing is also mounted on the base, so the crossbar is movable about the axis of rotation of the second bearing in response to transverse forces acting on the crossbar, and the transverse forces thereby produce a bending moment in the first beam through the coupling. In preferred embodiments, the coupling is slidable along the crossbar and along the first beam so that the resistance of the first beam to the bending moment is optionally adjustable.

A second beam in the apparatus has a longitudinal axis and is engaged, at a proximal end of the second beam, in a bracket attached to the crossbar. The second beam is engaged, at a distal end of the second beam, in a support that is also mounted on the base. The crossbar is rotatable about the axis of rotation of the first bearing in response to rotational forces acting on the crossbar, thereby to produce a bending moment in the second beam through the bracket. The support is optionally slidably engaged upon the base, and the second beam is optionally slidably engaged in the support, so that resistance of second beam to the bending moment is optionally made adjustable.

Preferably, the respective axes of the crossbar and of the first beam are generally parallel and concentric, and the respective longitudinal axes of the first and second beams mutually intersect perpendicularly.

A pointer is preferably mounted on the crossbar along an axis that is normal to both the axis of the crossbar and the axis of the first beam, and a handle, or preferably a pair of handles, are mounted on the ends of the crossbar.

In another embodiment of the invention, a game controlling apparatus has a game chair and the rest of the apparatus for providing progressively increasing resistance to, and preferably automatic self centering with respect to, an operator motion input to the apparatus as disclosed above.

In yet another embodiment, a game controlling apparatus has, in addition to the apparatus for providing progressively increasing resistance to an operator motion input to the apparatus disclosed above, a yoke mounted across the crossbar so that one end of the yoke engages one end of the crossbar and another end of the yoke engages the other end of the crossbar. The yoke preferably has a platform upon which a gamer may be supported for motion input to the apparatus, so that motion input to the yoke is transferred to the crossbar as transverse and rotational movement components in much the same manner as input motion is imparted to the basic invention apparatus through game handles attached to the ends of the crossbar. A gamer may thus deflect the respective axes (i.e., create motion input) by moving her entire body off a balance point. An optional conventional load sensor incorporated into the attachment points of the platform, motion (such as jumping) normal to the respective axes could also be detected. Such an embodiment could be use to simulate for computer interpretation any kinetic skill requiring balance and/or jumping, such as surfing, sailing, skiing, or skateboarding. In the realm of fantasy, the device could be used to simulate a flying carpet.

The invention in preferred embodiments employs flexible beam members whose resistance to bending moments applied to the beams is the means by which progressive resistance and self centering is effectuated. In alternate embodiments, however, the same or modified rod structures that are preferably used as the first beam are also concentric with and attached at their respective ends to the crossbar (such as with pins) so that rotational movements of the crossbar are transferred to the rods as torsional forces, so that the progressive resistance and self centering are effectuated by torsional spring tension of the concentric rod rather than by the flexible second beam spring. Similarly, the second beam rod could be pinned or otherwise held at both ends (at the bracket and at the support) so that transverse motion of the crossbar are transferred to the rod as torsional forces, so that the progressive resistance is effectuated by torsional spring tension of the second beam, rather than by the flexible first beam. It is contemplated however that some advantage may be had by combining both the beam and the torsional spring structures in the same mechanism. Of course, in torsion sprung embodiments, variations in attachment, alignment of respective spring rod axes, and number of torsion spring rods are all contemplated without departing from the scope of the invention.

BEST MODE OF CARRYING OUT THE INVENTION

Figure 1:
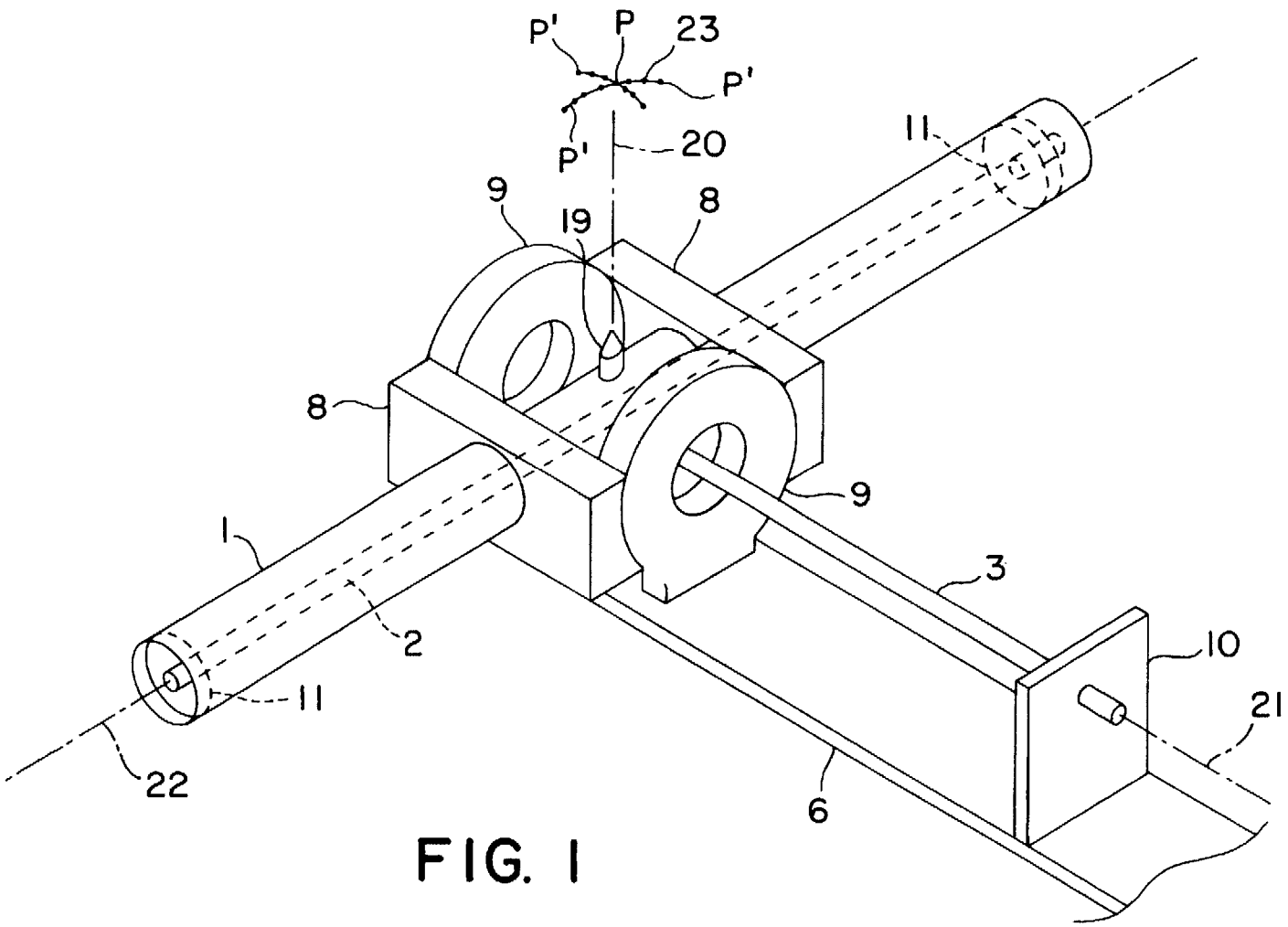
FIG. 1 is a perspective view of one the preferred embodiments of the progressive resistance mechanism of the invention.

Preliminarily it should be noted that automatic self centering, when used in this specification, refers to the property in a game controller of having the control handle return, or tend to return, to an upright and centered position. Where referred to, the bracket attached to the crossbar can be any conventional clamping or grasping type attachment means, such as will readily occur to those skilled in the art. "Cantilever mounted" means generally mounted at one end of a beam to set up a cantilever beam structure. Motion input means any kind of movement from an operator or gamer that is intended to be translated into game action on the screen. In conventional terms, this is typically hand and arm motion imparted to the joystick controller. Proximal and distal means respectively near and far.

Turning now to the drawings, the invention will be described in a preferred embodiment by reference to the numerals of the drawing figures wherein like numbers indicate like parts.

Figure 2:
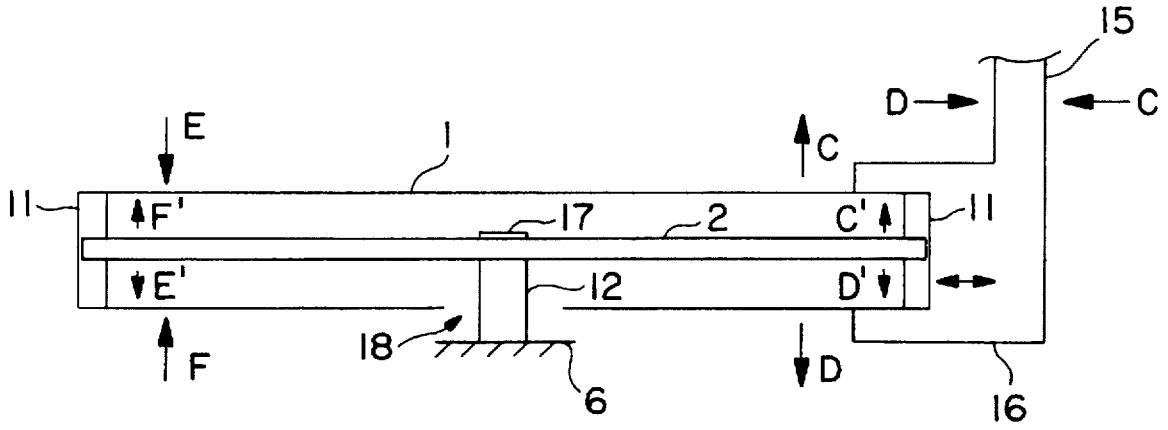
FIG. 2 is a schematic sectional view of part of the mechanism illustrated in FIG. 1.
Figure 3:
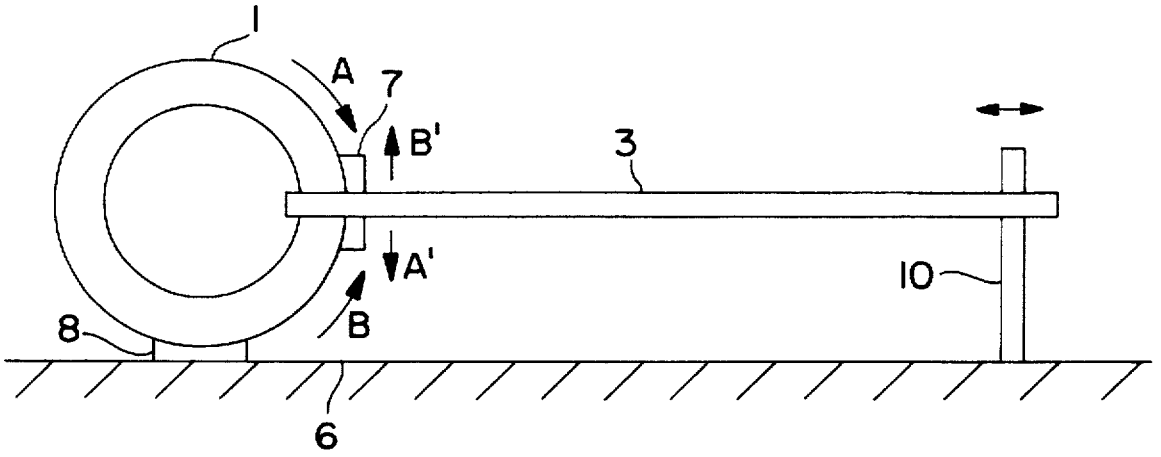
FIG. 3 is a schematic sectional view of part of the mechanism illustrated in FIG. 1.

In FIG. 1, the internal spring mechanism of the invention is partly illustrated. A better understanding of the structure and workings of the invention may be had by viewing FIGS. 2 and 3 together with FIG. 1. On a base 6 a dual bearing system 8 and 9 is mounted. First bearing blocks 8 rotate upon second bearings 9 which are preferably affixed to base 6. The respective rotational axes of bearings 8 and 9 are mutually perpendicular, as will be appreciated by those skilled in the art. First bearing blocks 8 may be a pair of molded Delrin® plastic blocks with matching curved inner surfaces for bearing upon the outer races of bearings 9, which may be simply stamped sheet metal. Bearing system 9 then is comprised of the curved inner races on bearing blocks 8 and the outer races of bearings 9, while bearing system 8 is comprised of the bores in bearing blocks 8 in which crossbar 1 is a slip fit, together with the outer surface of crossbar 1. Other equivalent conventional bearing systems may be made to serve as well.

Crossbar 1, which is preferably a relatively rigid tube structure, such as a length of 14 gauge 1020 welded steel pipe, is a slip fit in, and rotatably mounted in, bores in first bearing blocks 8, and axially restrained therein in some conventional manner known to those skilled in the art, such as by C-clips or the like. Crossbar 1 has an aperture 18 in a mid portion that opens toward and faces base 6. Attached to base 6 and projecting through aperture 18 is pedestal 12. In preferred embodiments, first beam 2 is clamped to pedestal 12 by clamp 17. Alternatively, beam 2 may be welded or glued to pedestal 12. In preferred embodiments, first beam 2 is advantageously concentric in tubular crossbar 1, but alternate constructions may serve as well. For instance, beam 2 may be outside of crossbar 1 and connected by only one end to one end of crossbar 1. As another example, beam 2 may be outside crossbar 1 and parallel to it, either spaced and connected to, or adjacent to, crossbar 1. Beam 2 may also be comprised of one "beam" coupled to each end of crossbar 1. Skew and other non-parallel and non-perpendicular alignments of beams with respect to the crossbar are also contemplated, but not preferred. The beams preferred are made of 7/32 inch oil hardened spring steel wire or rod, but may advantageously be comprised of more than one spring rod for each "beam".

In preferred embodiments, collars 11 provide a linkage between first beam 2 and crossbar 1. Preferred collars 11 are some readily available plastic material such as PVC, but may advantageously be comprised of some more elastic or resilient material. In any of the alternate or preferred constructions referred to above, transverse motion of crossbar 1 (illustrated by motion arrows C, D, E, or F in FIG. 2) about the rotational axis of second bearing 9 imparts a force (through collars 11 in preferred embodiments) to first beam 2, resulting in a bending moment in the beam in a corresponding direction C', D', E', or F' (for instance, transverse force in direction E on crossbar 1 produces bending moment in beam 2 in direction E'), all as will be appreciated by those skilled in the art.

In preferred game chair embodiments of the invention, a handle 15 is attached to crossbar 1 by way of bar cap 16. As will be appreciated by those skilled in the art, motions at the handle (such as those illustrated by arrows D and C at handle 15) will result in corresponding motions illustrated by arrows C and D at the crossbar. Handle 15 is conventionally attached to bar cap 16 and bar cap 16 is conventionally attached to crossbar 1, such as by pins (not shown).

When crossbar 1 is rotated in bearing 8 about its own longitudinal axis 22 (motions illustrated schematically by arrows A and B in FIG. 3), bracket 7 attached to crossbar 1 transmits that motion to the end of second beam 3 (to produce bending moments in directions A' and B' in FIG. 3) whose other end is cantilever supported in support 10 connected to base 6. Preferred embodiments of the invention employ slidably connected support 10 and slidable collars 11 so that beam spring resistance for particular beam cross sections and materials can be adjustably increased or decreased to suit the needs or preferences of game player users. Second beam 3 is preferably also made of 7/32 inch oil hardened spring steel wire or rod.

Though user input motion (whether via the handles or otherwise) may be "read" or sensed, all as will be appreciated by those skilled in the art, at various locations on the mechanism of the invention (such as at adjoining alignment reference markings on bearings 8 and 9, or at adjoining reference markings on crossbar 1 and bearing 8), in preferred embodiments of the invention, pointer 19 is employed. Pointer 19 is concentric with axis 20 which is in turn mutually perpendicular with axis 22 (axis of rotation of crossbar 1 in bearing 8), and with axis 21 (which is the axis of rotation of bearing 8 about bearing 9, and also the preferred longitudinal axis of second beam 3). Since user input motion at handles 15 is necessarily constrained to arcuate motion by the pivotal and relatively rigid nature of the system components, and since the rotational elements of the invention are not readily susceptible to rotational distortion, any given point P on axis 20 will generate points P' as motion is input into the system, and the locus 23 of all points P' and P will be a partial spherical surface, as will be appreciated by those skilled in the art. First and second beams will, by the nature of their materials and the forces imparted, be progressively more resistant to further bending.

Figure 5:
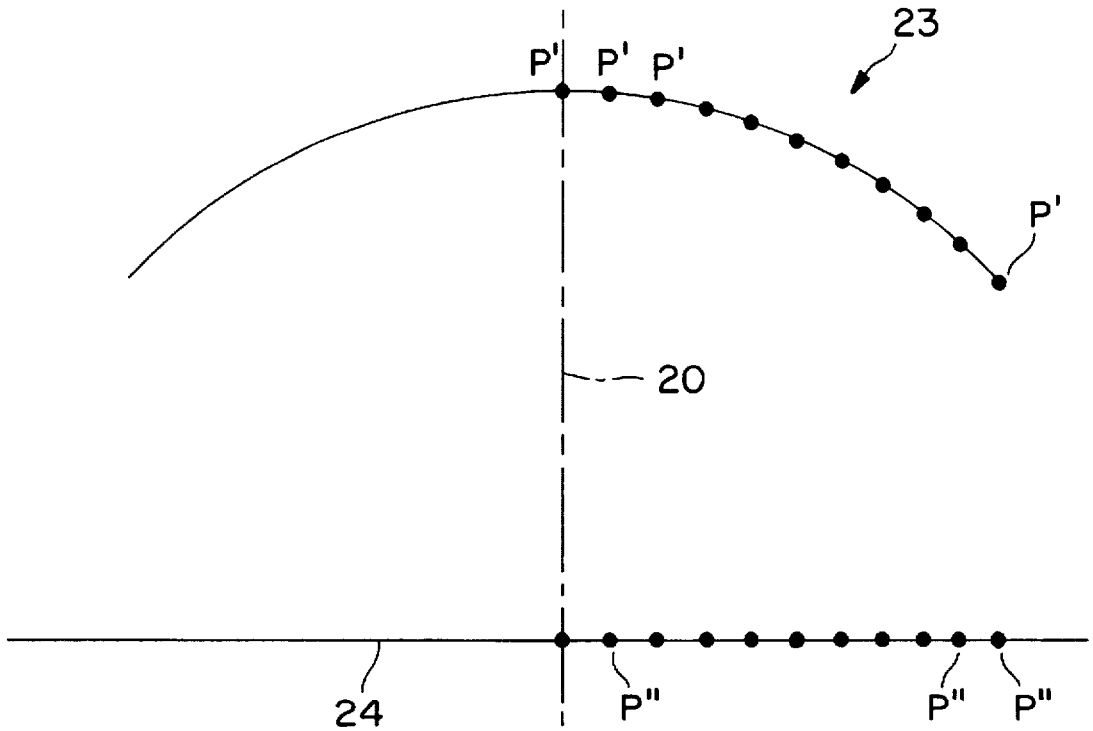
FIG. 5 is a schematic illustration of point density gradation in accordance with the invention.

In addition to these progressive resistances to motion tending to move pointer 19 off of axis 20, motion "off the center" leads to an increasing planar density of possible points P' (see FIG. 5). In other words, when the spherical locus 23 of points P' is visualized as projected onto a plane 24, such a projection (of for instance uniformly angularly displaced points on the spherical locus 23) show an increasing point density concentration from center (axis 20). It would seem that the net effect of this increasing point density would be decreasing image movement in the game for uniform angular incremental changes in user input motion as the motion progressed from center to off center, as long as the game image movement readings are taken from the planar projection, instead of from the spherical surface itself. In FIG. 5, by way of illustration, it can be seen that as one moves from axis 20 to the first point P' (an angular displacement of 5 degrees, as are all of the points P' in the Figure from each other), the corresponding projected point P" is an "x" distance from axis 20. Then as succeeding 5 degree displacements are marked off for succeeding points P' away from axis 20, the "x" distance between points P" plainly decreases significantly.

Thus, it is believed that there are two beneficial effects of the invention in terms of progressively attenuated output screen motion for relatively uniform incremental gamer input motion-progressive mechanical resistance, and progressive incremental motion distance attenuation (at least in a projected plane, as opposed to the actual spherical locus), as the points P' are conventionally converted to game information in a manner well known to those skilled in the art. Optionally in one embodiment, points P' are the points read and converted to game movement; in another embodiment, "projected" points P" are the points converted to game movement. In this latter embodiment, in addition to the benefits summarized above, an inverse benefit also becomes apparent-relatively greater motion sensitivity near axis 20.

Figure 4:
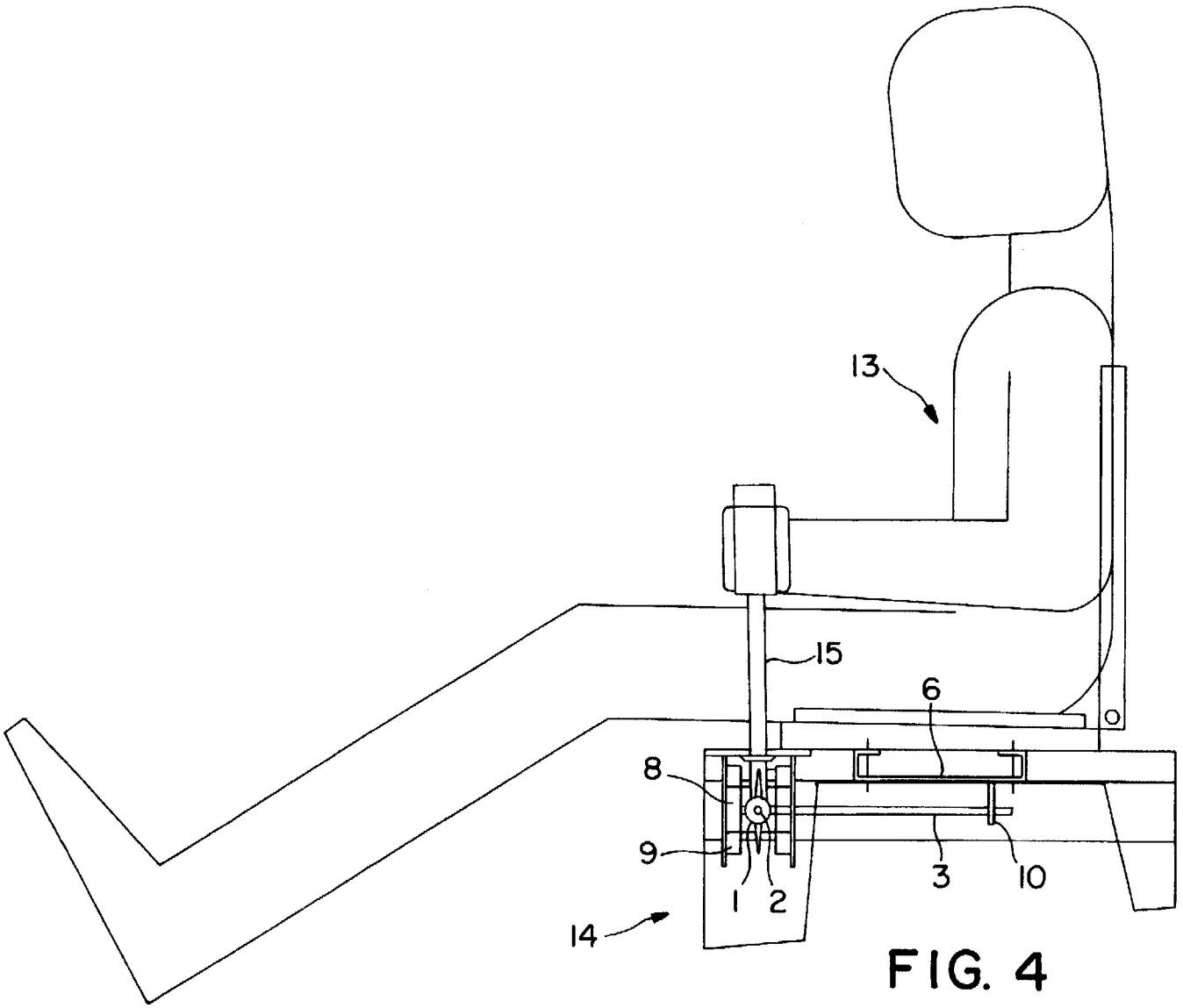
FIG. 4 is a schematic side elevation and partial section of a game chair employing the invention.

In FIG. 4, an example illustration of the possible positioning and integration of the invention into a two handled game chair 14 with seated gamer 13 is shown. In the chair embodiment it will be noted that base 6 is attached upside down to the bottom of the chair, with beam support 10 thus projecting downwardly to receive one end of second beam 3. In this view, crossbar 1 and first beam 2 are seen in end view, and bearings 8 and 9 can also be seen. Handles 15, when operated by gamer 13 in response to game action, cause crossbar 1 to move as described above, against the resistance of beams 2 and 3.

With regard to systems and components above referred to, but not otherwise specified or described in detail herein, the workings and specifications of such systems and components and the manner in which they may be made or assembled or used, both cooperatively with each other and with the other elements of the invention described herein to effect the purposes herein disclosed, are all believed to be well within the knowledge of those skilled in the art. No concerted attempt to repeat here what is generally known to the artisan has therefore been made.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

I claim:

1. An apparatus for providing progressively increasing resistance to, and automatic self centering with respect to, an operator motion input to the apparatus, the apparatus comprising:

a. a crossbar having a longitudinal axis and connected to a first beam with a coupling, the first beam having a longitudinal axis and cantilever mounted on a base, the crossbar mounted in a first axial bearing for rotation about the crossbar's longitudinal axis, the first bearing rotatably mounted in a second axial bearing, the axes of rotation of the first and second bearings being mutually perpendicular, the second bearing mounted on the base, whereby the crossbar is movable about the axis of rotation of the second bearing in response to transverse forces acting on the crossbar, thereby to produce a bending moment in the first beam through the coupling and a progressively increasing resistance to the transverse forces;

b. a second beam having a longitudinal axis and engaged at a proximal end of the second beam in a bracket attached to the crossbar, and engaged at a distal end of the second beam in a support that is mounted on the base;

wherein the coupling is slidable along the crossbar and along the first beam whereby through selective positioning of the coupling with respect to the crossbar and the first beam resistance of the first beam to the bending moment is adjustable.

2. An apparatus for providing progessively increasing resistance to, and automatic self centering with respect to, an operator motion input to the apparatus, the apparatus comprising:

a. a crossbar having a longitudinal axis and connected to a first beam with a coupling, the first beam having a longitudinal axis and cantilever mounted on a base, the crossbar mounted in a first axial bearing for rotation about the crossbar's longitudinal axis, the first bearing rotatably mounted in a second axial bearing, the axes of rotation of the first and second bearings being mutually perpendicular, the second bearing mounted on the base, whereby the crossbar is movable about the axis of rotation of the second bearing in response to transverse forces acting on the crossbar, thereby to produce a bending moment in the first beam through the coupling and a progressively increasing resistance to the transverse forces;

b. a second beam having a longitudinal axis and engaged at a proximal end of the second beam in a bracket attached to the crossbar, and engaged at a distal end of the second beam in a support that is mounted on the base;

wherein the first beam is comprised of a spring steel rod.

3. An apparatus for providing progressively increasing resistance to, and automatic self centering with respect to, an operator motion input to the apparatus, the apparatus comprising:

a. a crossbar having a longitudinal axis and connected to a first beam with a coupling, the first beam having a longitudinal axis and cantilever mounted on a base, the crossbar mounted in a first axial bearing for rotation about the crossbar's longitudinal axis, the first bearing rotatably mounted in a second axial bearing, the axes of rotation of the first and second bearings being mutually perpendicular, the second bearing mounted on the base, whereby the crossbar is movable about the axis of rotation of the second bearing in response to transverse forces acting on the crossbar, thereby to produce a bending moment in the first beam through the coupling and a progressively increasing resistance to the transverse forces;

b. a second beam having a longitudinal axis and engaged at a proximal end of the second beam in a bracket attached to the crossbar, and engaged at a distal end of the second beam in a support that is mounted on the base;

wherein the first beam is comprised of two spring steel rods.

4. An apparatus for providing progressively increasing resistance to, and automatic self centering with respect to, an operator motion input to the apparatus, the apparatus comprising:

a. a crossbar having a longitudinal axis and connected to a first beam with a coupling, the first beam having a longitudinal axis and cantilever mounted on a base, the crossbar mounted in a first axial bearing for rotation about the crossbar's longitudinal axis, the first bearing rotatably mounted in a second axial bearing, the axes of rotation of the first and second bearings being mutually perpendicular, the second bearing mounted on the base, whereby the crossbar is movable about the axis of rotation of the second bearing in response to transverse forces acting on the crossbar, thereby to produce a bending moment in the first beam through the coupling and a progressively increasing resistance to the transverse forces;

b. a second beam having a longitudinal axis and engaged at a proximal end of the second beam in a bracket attached to the crossbar, and engaged at a distal end of the second beam in a support that is mounted on the base;

wherein the support is slidably engaged upon the base, and the second beam is slidably engaged in the support, whereby through selective positioning of the support with respect to the second beam resistance of the second beam to the bending moment is adjustable.

5. A game controlling apparatus comprising:

a. a game chair;

b. a crossbar having a longitudinal axis and connected to a first beam with a coupling, the first beam having a longitudinal axis and cantilever mounted on a base, the base mounted upside down on an underside of the chair, the crossbar mounted in a first axial bearing for rotation about the crossbar's longitudinal axis, the respective longitudinal axes of the crossbar and the first beam parallel to each other, the first bearing rotatably mounted in a second axial bearing, the axes of rotation of the first and second bearings being mutually perpendicular, the second bearing mounted on the base, whereby the crossbar is movable about the axis of rotation of the second bearing in response to transverse forces acting on the crossbar, thereby to produce a bending moment in the first beam through the coupling;

c. a second beam having a longitudinal axis and engaged at a proximal end of the second beam in a bracket attached to the crossbar, and engaged at a distal end of the second beam in a support that is mounted on the base.

6. The apparatus of claim 5 whereby the crossbar is rotatable about the axis of rotation of the first bearing in response to rotational forces acting on the crossbar, thereby to produce a bending moment in the second beam through the bracket.

* * * * *